United States Patent [19]

Golner et al.

[11] 3,949,918

[45] Apr. 13, 1976

[54] MACHINE FOR DISPENSING UNIFORM LENGTHS OF THICK PLASTIC FILM

[75] Inventors: Jerold Julius Golner, Lowell; Russell Brown Strout, Winchester, both of Mass.

[73] Assignee: Borden, Inc., Columbus, Ohio

[22] Filed: Aug. 5, 1974

[21] Appl. No.: 494,623

[52] U.S. Cl. ..... 225/11; 225/20

[51] Int. Cl.[2] ..... B26F 3/02

[58] Field of Search ..... 225/8, 10, 11, 12, 13, 225/14, 15, 19, 20, 77; 83/648, 649, 650

[56] References Cited

UNITED STATES PATENTS

| | | | |
|---|---|---|---|
| 2,275,410 | 3/1942 | Anderson | 225/11 |
| 3,125,266 | 3/1964 | Kindseth | 225/14 X |
| 3,156,391 | 11/1964 | Wicksall | 225/77 X |
| 3,507,428 | 4/1970 | Leibreich | 225/11 |
| 3,595,456 | 7/1971 | Rosenthal | 225/11 |
| 3,626,491 | 12/1971 | Grosser | 225/8 |
| 3,730,409 | 5/1973 | Ratti | 225/10 X |
| 3,731,863 | 5/1973 | Nausedas | 225/20 |
| 3,837,549 | 9/1974 | Sengwald | 225/11 |

*Primary Examiner*—Travis S. McGehee
*Assistant Examiner*—John Sipos
*Attorney, Agent, or Firm*—Daniel D. Mast; George P. Maskas; George A. Kap

[57] ABSTRACT

A machine for dispensing thick plastic film has two cradle rollers which carry a heavy roll of thick plastic film, two nipper rolls which draw film from the roll of plastic film, a timer regulated motor which drives the nipper rolls to dispense a pre-selected length of film and a knife to cut the film. The use of the knife reactivates the machanism to dispense a second given length of film and the process is infinitely repeated. The heavy plastic film dispensed is used to cover the sharp jagged edges of bones of primal or subprimal cuts of meat prior to the cuts being placed in plastic bags or wrapped in plastic film. The heavy plastic film protects the plastic bag or wrapping film from puncture by the jagged edges of the bones.

2 Claims, 4 Drawing Figures

MACHINE FOR DISPENSING UNIFORM LENGTHS OF THICK PLASTIC FILM

BACKGROUND OF THE INVENTION

This invention relates to a dispenser for a uniform length of heavy gauge plastic film, used to cover the sharp edges of bones of primal and subprimal cuts prior to packaging the cuts in thin plastic film bags.

In the packaging of primal or subprimal cuts of meat, it has been necessary to guard the packaging material from the sharp edges of protruding bones. This has been accomplished in the past by covering the sharp edges of protruding bones with a cloth impregnated with wax. The wax coated cloth was supplied in large rolls, strips were cut by hand often by one man and delivered to the packaging station, usually to another man, who applied these wax impregnated cloth strips to the sharp edges of the bones prior to the final packaging. At the final packaging stage, the primal cut or subprimal cut was either inserted into a plastic bag and a vacuum drawn on the bag to preserve the packaged meat or the cut was wrapped in a plastic film.

The present invention is directed to a machine which dispenses uniform lengths of thick plastic film automatically, the film to be used for covering the sharp edges of cut bones of primal and subprimal cuts prior to the final packaging. The machine eliminates the need for a man to cut wax impregnated cloth and supply it to another man for application to a cut of meat. The machine also provides for a means of applying a material to a cut of meat to facilitate inspection by government meat inspectors and also provides a more inexpensive way of protecting an outer plastic covering from puncture by sharp protruding bones.

DESCRIPTION OF THE PREFERRED EMBODIMENTS

Figure 1:
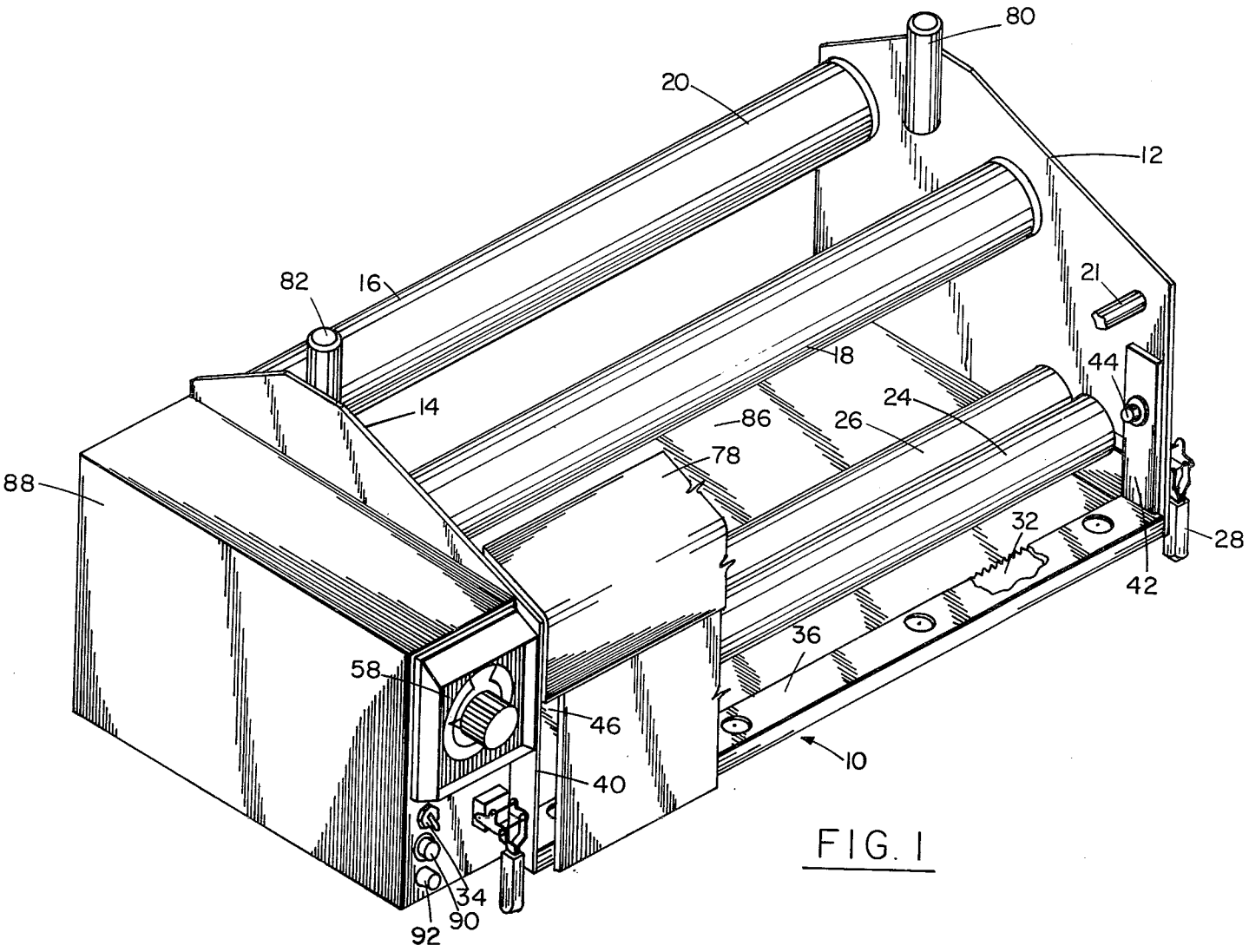
FIG. 1 is a perspective view partially in section of the film dispensing machine with the control box attached to the side thereof.
Figure 3:
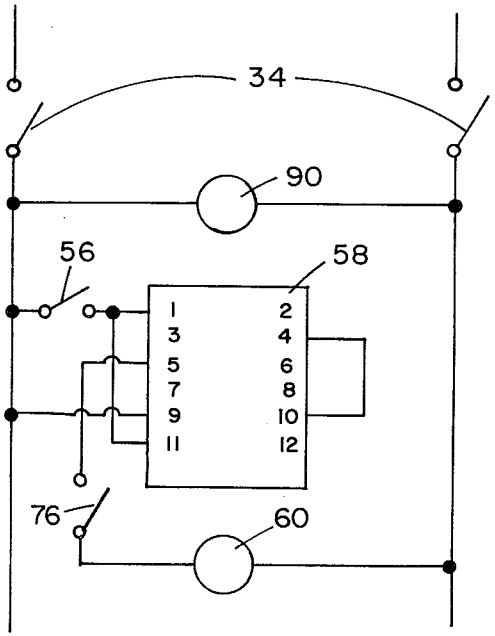
FIG. 3 is a circuit diagram of the electrical components of the control box.

In referring to the drawings in detail, FIG. 1 in particular, the machine comprises a frame 10, having two side walls 12 and 14, two support rolls 16 and 18 rotatably mounted between the two side walls, 12 and 14; the two support rolls being parallel in the horizontal plane.

A roll of packaging film is supported on the support rolls, 16 and 18. The film is fed from the film roll and the end of the strip of film is fed between two nipper rolls, 24 and 26. Nipper rolls 24 and 26 are separated for the insertion of the film between them by the means of two hand-operated double-acting plunger clamps 28 and 30. The clamps are described in detail in U.S. patent 3,237,463, McPherson 1966. The film is pulled down below cut-off blade 32, which is mounted several inches below the nipper roll assembly 24 and 26. The clamps 28 and 30 are then returned to their closed position securing the flim 22 between the nipper rolls 24 and 26.

Figure 2:
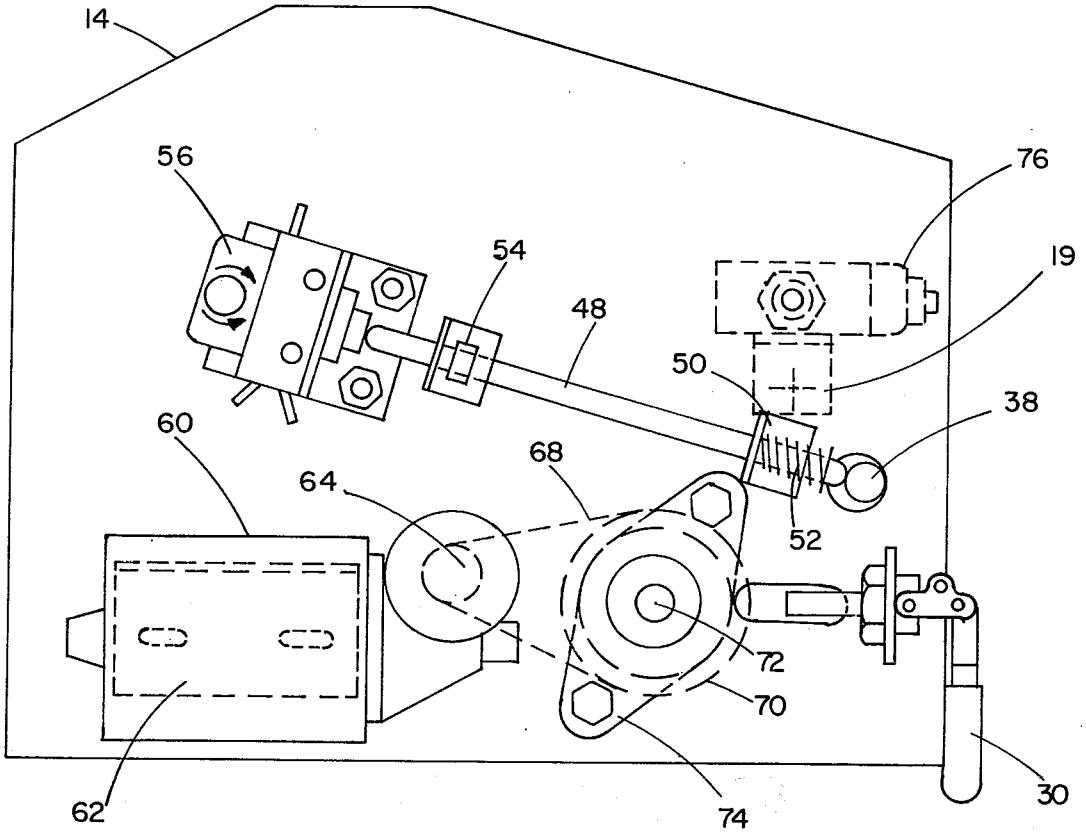
FIG. 2 is an end view of the control box with the outher cover removed.
Figure 4:
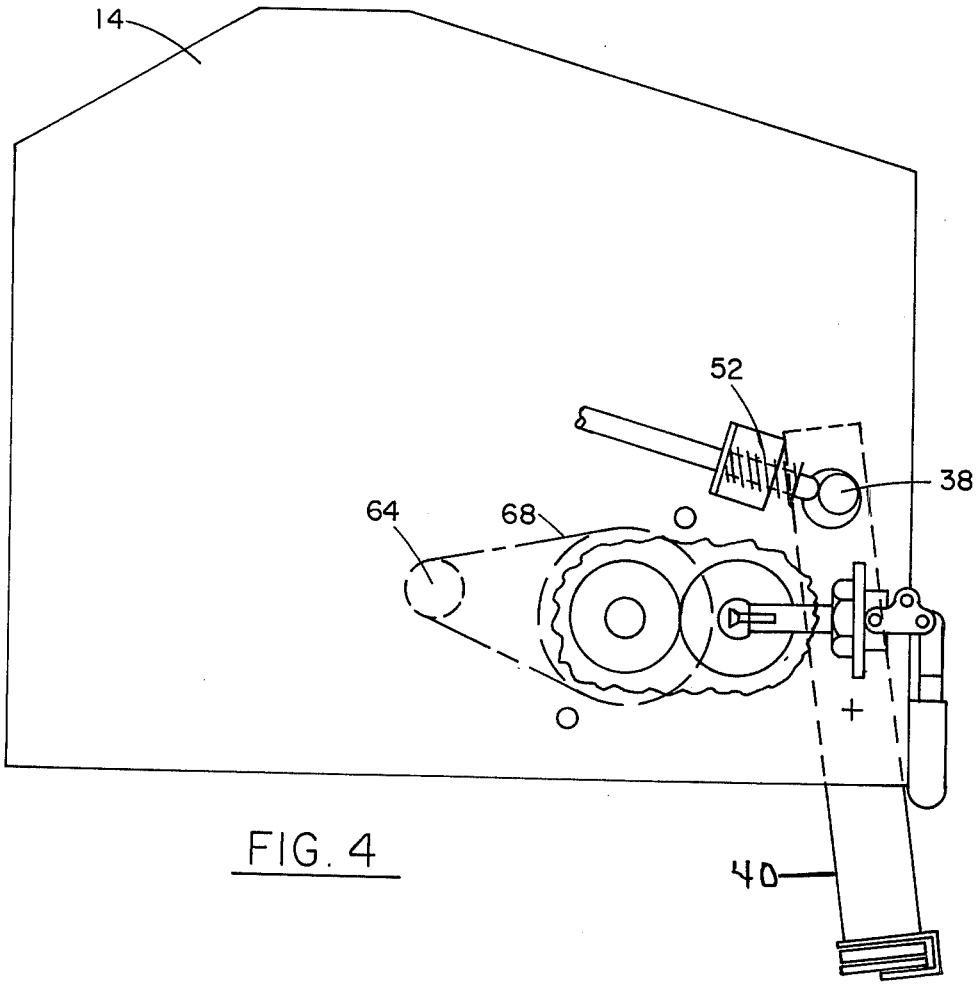
FIG. 4 is an end view partially in section of the control box and of the film dispensing machine.

With line switch 34, in the On position, the operator of the machine holds the film 22 against the guard 36 covering the cut-off blade 32. The guard moves back exposing the cut-off blade on which the film is severed. The movement of the guard 36 activates a switch and pneumatic time delay 56. The switch and delay assembly is shown in FIGS. 2 and 4. It consists of pin 38 which is attached to blade guard support arm 40 which corresponds to the right blade guard support arm 42. The blade guard support arm is pivoted at pivot point 46 not shown, but which corresponds to the shown pivot point 44 on the right-hand side. The support arms and pivot point are shown in FIG. 1.

Referring again to FIG. 2, the pin 38 activates push-rod 48, slidable in push-rod bracket 50. The push-rod is held in place against pin 38 by push-rod spring 52. The upper left portion of the push-rod is guided by collar 54 to activate a pneumatic time delay 56. A preset length of time after the activation, the pneumatic time delay 56 energizes an electric timer 58 (shown in FIG. 1) which in turn starts motor 60 and allows it to run for a pre-determined time interval which is translated into inches of material dispensed. Motor 60 is mounted on motor bracket 62 and drives sprocket 64. Sprocket 64 drives chain 68 which in turn drives sprocket 70 which is attached to the shaft of nipper roller 26. The shaft 72 of drive sprocket 70 is supported in flange bearing 74. The inches of material which is dispensed is torn off by the operator and placed upon the jagged edges of the primal or subprimal cut of meat and the meat is then covered with a thinner, plastic film bag.

When the operator tears off a sheet of the thick plastic film, the pin 38 causes a reactivation of the mechanism and the second sheet of the same length is dispensed. As a safety feature, a second limit switch 76 is positioned at the front of side wall 14. Limit switch 76, cuts off all power to the machine when front guard 78 is opened. Front guard 78 pivots on tie rod 21. This prevents the operator from jamming his fingers when feeding film between the nipper rolls.

In order to insure that the edges of the film on the roll 20 do not strike side plate 12 and 14, side pins 80 and 82 are provided. These side pins contact the core of the roll which extends beyond the edge of the film. The core is usually made of cardboard or plastic. These pins 80 and 82 only serve a function when the thickness of the film on bottom side of the roll extends above side plate 12 and 14.

Other features not described in detail earlier of the device include tie rod 21 which joins side plates 12 and 14 and provides rigidity. Base plate 86 joins side plates 12 and 14 again providing structural rigidity. The control box cover is generally shown at 88. A red indicator light is shown at 90. This light indicates when the device is on. The device is also fused and the fuse is shown at 92.

In the accompanying drawings, one preferred embodiment of the invention is illustrated to show the best mode now known to us for practicing the invention, but we do not wish to be limited to the specific construction illustrated and we intend to cover our invention in whatever forms its principle may be embodied.

We claim:

1. In a machine for dispensing plastic film in premeasured lengths, a frame having a base and two vertical side walls; two support rolls with shafts journalled and rotatably mounted between the two side walls, said two support rolls being parallel in the horizontal plane and positioned to support a roll of packaging film; two nipper rolls with shafts jounalled and mounted between the two side walls, said nipper rolls being parallel in the horizontal plane and at least one of the nipper rolls being power driven, said nipper rolls being positioned to draw film from the film roll supported on the support rolls; a fixed cut-off knife horizontally mounted between the two side walls and positioned to be contactable with film drawn through the nipper rolls; a knife guard co-extensive with said knife and mounted on a pair of opposed arms, one arm being at each end of said guard and pivotably mounted to its adjacent side wall to cover and uncover the blade; an eccentric pin mounted on the frame rotated by the swinging of the guard away from the cutting edge of the blade; a push-rod that transmits the force from the movement of said eccentric pin to a time delay switch; a time delay switch mounted on the frame which when activated by the movement of the pin and push-rod transmits a signal after a preset period of time; a timer mounted on the frame activatable by the signal from the time delay switch which electric timer provides an electric current for a preset length of time; an electric motor mounted on the frame and electrically connected to said electric timer which motor runs during the time that the current is supplied to it, the time being correlatable with the number of revolutions that the motor turns; a mechanical connection between the motor and at least one of the nipper rollers providing for a translation of motor rotation into rotation of the nipper roller.

2. The machine of claim 1 wherein a front guard is provided between the two side walls to protect workers from injury by the nipper rollers and knife mechanism.

* * * * *